US008726618B1

(12) United States Patent
Laurita

(10) Patent No.: US 8,726,618 B1
(45) Date of Patent: May 20, 2014

(54) METHOD OF MAKING AND USING A FOLDABLE AND STACKABLE BOX

(71) Applicant: Joseph N. Laurita, Wayne, NJ (US)

(72) Inventor: Joseph N. Laurita, Wayne, NJ (US)

( * ) Notice: Subject to any disclaimer, the term of this patent is extended or adjusted under 35 U.S.C. 154(b) by 0 days.

(21) Appl. No.: 13/848,415

(22) Filed: Mar. 21, 2013

(51) Int. Cl.
*B65D 6/26* (2006.01)
*B65D 6/18* (2006.01)
*B65D 21/02* (2006.01)

(52) U.S. Cl.
CPC ..... *B65D 11/1833* (2013.01); *B65D 21/0213* (2013.01); *Y10S 229/915* (2013.01)
USPC ..... 53/456; 53/458; 220/4.28; 220/6; 220/62; 220/636; 206/509; 206/519; 206/520; 229/915

(58) Field of Classification Search
CPC ..... B65D 11/1833
USPC ..... 53/456, 458; 206/503, 509, 519, 520; 220/4.28, 6, 62, 62.1, 628, 636; 229/122.34, 915
See application file for complete search history.

(56) References Cited

U.S. PATENT DOCUMENTS

| | | | | |
|---|---|---|---|---|
| 2,517,178 A | | 8/1950 | Cheatham | 217/15 |
| 2,706,064 A | * | 4/1955 | Vitols | 220/504 |
| 2,757,853 A | * | 8/1956 | Main | 229/117.17 |
| 2,802,589 A | * | 8/1957 | Voight | 206/509 |
| 2,841,306 A | | 7/1958 | Vitoux | 220/7 |
| 2,843,291 A | * | 7/1958 | Stopps | 206/509 |
| 3,250,430 A | * | 5/1966 | Cella | 220/637 |
| 3,371,816 A | | 3/1968 | Ricci | 220/4.28 |
| 3,376,994 A | * | 4/1968 | Flinn, Jr. | 220/6 |
| 3,469,762 A | | 9/1969 | Torre | 229/122 |
| 3,476,303 A | | 11/1969 | Smith | 229/117.08 |
| 3,497,127 A | | 2/1970 | Box | 220/7 |
| 3,735,430 A | | 5/1973 | Platz | 5/118 |
| 3,889,837 A | | 6/1975 | Wilson | 220/7 |
| 3,938,819 A | | 2/1976 | Martin | 280/19 |
| 4,057,165 A | | 11/1977 | Kardell | 220/6 |
| 4,171,058 A | | 10/1979 | Collins | 217/12 R |
| 4,181,356 A | | 1/1980 | Fleischer | 297/350 |
| 4,256,236 A | | 3/1981 | Haase | 220/6 |
| 4,609,116 A | | 9/1986 | Simms | 217/12 |
| 4,781,300 A | | 11/1988 | Long | 220/7 |

(Continued)

FOREIGN PATENT DOCUMENTS

| | | | | |
|---|---|---|---|---|
| DE | 3622079 A1 | * | 11/1987 | 206/509 |
| DE | 3809585 A1 | * | 10/1989 | 206/509 |

(Continued)

*Primary Examiner* — Stephen F Gerrity
(74) *Attorney, Agent, or Firm* — Walter J. Tencza, Jr.

(57) ABSTRACT

An apparatus including a box portion which may include a left side, a right side, a front side, a rear side, and a bottom. Each of the left, the right, the front, and the rear sides is connected to the bottom to be foldable with respect to the bottom, from an orientation parallel to the bottom to an orientation substantially perpendicular to the bottom. A device may be connected to the bottom, including an inner peripheral wall which extends, substantially perpendicularly from the bottom. The inner peripheral wall may be substantially in the shape of a loop and may have a width and a length, substantially perpendicular to the height of the device, slightly less than a width and a length, respectively, of an inner chamber defined by top edges of the left, the right, the front, and the rear sides, of the box portion in an upright state.

8 Claims, 12 Drawing Sheets

(56) References Cited

U.S. PATENT DOCUMENTS

| | | | | |
|---|---|---|---|---|
| 4,955,925 | A | 9/1990 | Platti | 15/257.6 |
| 4,978,021 | A * | 12/1990 | Mini et al. | 220/8 |
| 5,211,434 | A | 5/1993 | Lanava | 220/7 |
| 5,346,929 | A * | 9/1994 | Guttag | 523/124 |
| 5,538,153 | A * | 7/1996 | Marovskis et al. | 220/6 |
| 5,588,549 | A | 12/1996 | Furtner | 220/7 |
| 5,597,084 | A | 1/1997 | Parasin | 220/4.28 |
| 5,743,389 | A | 4/1998 | Cutler | 206/216 |
| 6,233,766 | B1 | 5/2001 | Ohman | 5/627 |
| 6,640,944 | B2 | 11/2003 | Adams | 190/110 |
| 7,909,000 | B1 | 3/2011 | O'Neill | 119/61.1 |
| 8,375,687 | B2 | 2/2013 | Laurita | 53/458 |
| 2004/0155037 | A1 * | 8/2004 | Hoogland | 220/6 |
| 2005/0173269 | A1 | 8/2005 | Lebras | 206/170 |
| 2005/0189388 | A1 | 9/2005 | Godshaw | 224/607 |
| 2006/0201849 | A1 | 9/2006 | Huang | 206/736 |
| 2010/0230479 | A1 | 9/2010 | Graham | 229/108.1 |
| 2012/0061277 | A1 | 3/2012 | Lohse | 206/504 |
| 2012/0067878 | A1 * | 3/2012 | Orgeldinger | 220/6 |

FOREIGN PATENT DOCUMENTS

| | | | | |
|---|---|---|---|---|
| DE | 4446322 | A1 * | 4/1996 | B65D 11/1833 |
| EP | 602575 | A2 * | 6/1994 | 220/6 |
| FR | 2351865 | A1 * | 12/1977 | B65D 11/1833 |
| JP | 02045351 | A * | 2/1990 | 220/6 |
| JP | 03289439 | A * | 12/1991 | 220/4.28 |
| JP | 2004256142 | A * | 9/2004 | B65D 81/26 |

* cited by examiner

METHOD OF MAKING AND USING A FOLDABLE AND STACKABLE BOX

FIELD OF THE INVENTION

This invention relates to improved methods and apparatus concerning boxes and other receptacles.

BACKGROUND OF THE INVENTION

U.S. Pat. No. 8,375,687 to Laurita (Laurita '687) discloses an apparatus for transporting a plurality of beverage containers. The apparatus can be changed from a flattened state to an upright state. A plurality beverage containers is placed in the apparatus in the upright state for transport of the containers.

SUMMARY OF THE INVENTION

In at least one embodiment of the present invention an apparatus is provided comprising: a box portion which may include a left side, a right side, a front side, a rear side, and a bottom. Each of the left, the right, the front, and the rear sides are connected to the bottom so that each is configured to be foldable with respect to the bottom, from an orientation parallel to the bottom to an orientation substantially perpendicular to the bottom.

The apparatus further may include a device connected to the bottom, the device including an inner peripheral wall which extends, for a height of the inner wall, substantially perpendicularly from the bottom. The inner peripheral wall may be substantially in the shape of a loop and may have a width and a length, substantially perpendicular to the height of the device, wherein the width and the length of the inner peripheral wall are slightly less than a width and a length, respectively, of an inner chamber defined by top edges of the left, the right, the front, and the rear sides, when the box portion is in an upright state such that the left, the right, the front, and the rear sides are substantially perpendicular to the bottom, so that the inner peripheral wall is configured to fit snugly into an inner chamber of a second apparatus which is identical to the apparatus, and wherein the inner chamber of the second apparatus is identical to the inner chamber of the apparatus.

In at least one embodiment, the left side of the box portion includes first and second outer sections, and a central section, wherein the first outer section of the left side is connected to a first end of the central section of the left side and the second outer section of the left side is connected to a second end of the central section of the left side, which opposes the first end of the central section of the left side. Furthermore, the right side of the box portion includes first and second outer sections, and a central section, wherein the first outer section of the right side is connected to a first end of the central section of the right side and the second outer section of the right side is connected to a second end of the central section of the right side, which opposes the first end of the central section of the right side.

Each of the first and the second outer sections of the left side are connected to the central section of the left side so that each is configured to be foldable with respect to the central section of the left side, from an orientation parallel to the central section of the left side to an orientation substantially perpendicular to the central section of the left side. Each of the first and the second outer sections of the right side are connected to the central section of the right side so that each is configured to be foldable with respect to the central section of the right side, from an orientation parallel to the central section of the right side to an orientation substantially perpendicular to the central section of the right side.

The apparatus may be made of a biodegradable material. The apparatus may be made of a moisture absorbing material.

The apparatus may include a first plurality of beverage containers; wherein the inner chamber of the apparatus is configured to snugly fit a fixed number of the first plurality of beverage containers. The height of the inner peripheral wall of the device may be configured so that when the inner peripheral wall is inserted into an inner chamber of a second apparatus identical to the apparatus, in a manner to cause the first apparatus to be supported by the second apparatus, the inner peripheral wall does not contact any of a second plurality of beverage containers which fit snugly, in an upright state in the inner chamber of the second apparatus.

In at least one embodiment, a method is provided which may include attaching a device to a bottom of a box portion to form an apparatus. The box portion and the device may be as previously described. The method may further include fitting a fixed number of a first plurality of beverage containers in an upright state in an inner chamber of the apparatus.

The method may further include changing orientations of the right, left, front, and rear sides with respect to the bottom from a flattened state in which each of the right. left, front, and rear sides are substantially parallel to the bottom to an upright state in which each of the right, left, front, and rear sides are substantially perpendicular to the bottom; attaching the right side to the front and rear sides in the upright state; and attaching the left side to the front and rear sides in the upright state.

In at least one embodiment, the right side may be attached to the front side by attaching the first outer section of the right side to the front side, and the right side is attached to the rear side by attaching the second outer section of the right side to the rear side. The left side may be attached to the front side by attaching the first outer section of the left side to the front side, and the left side may be attached to the rear side by attaching the second outer section of the left side to the rear side.

The method may further include stacking the apparatus onto a second apparatus which is identical to the apparatus such that the box portion of the apparatus is in an upright state such that the left, the right, the front, and the rear sides are substantially perpendicular to the bottom, and a box portion of the second apparatus is in an upright sate such that the left, the right, the front, and the rear sides are substantially perpendicular to the bottom, and the inner peripheral wall of the apparatus is fit snugly into an inner chamber of the second apparatus, and wherein the inner chamber of the second apparatus is identical to the inner chamber of the apparatus.

DETAILED DESCRIPTION OF THE DRAWINGS

Figure 1:
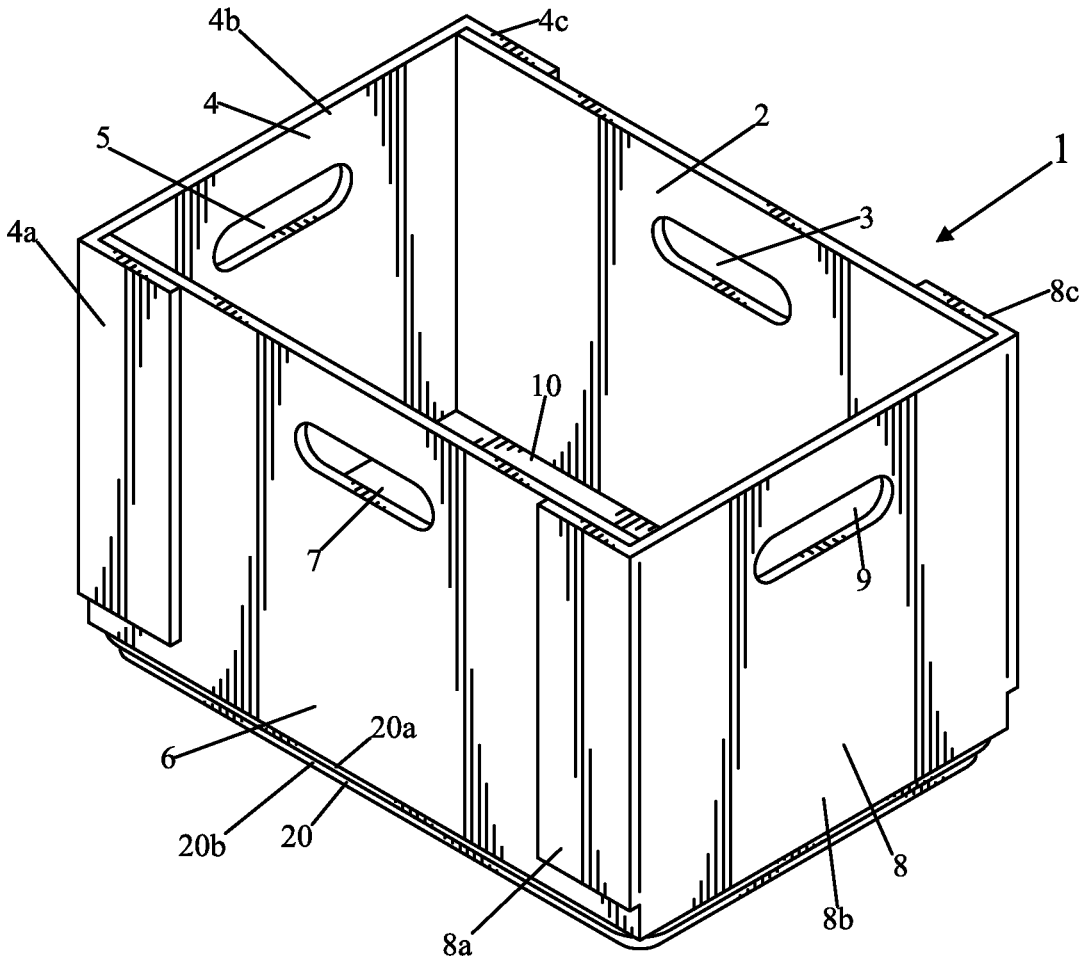
FIG. 1 shows a top, front, right perspective view of a receptacle in accordance with an embodiment of the present invention, with the receptacle shown in an upright assembled state.
Figure 2:
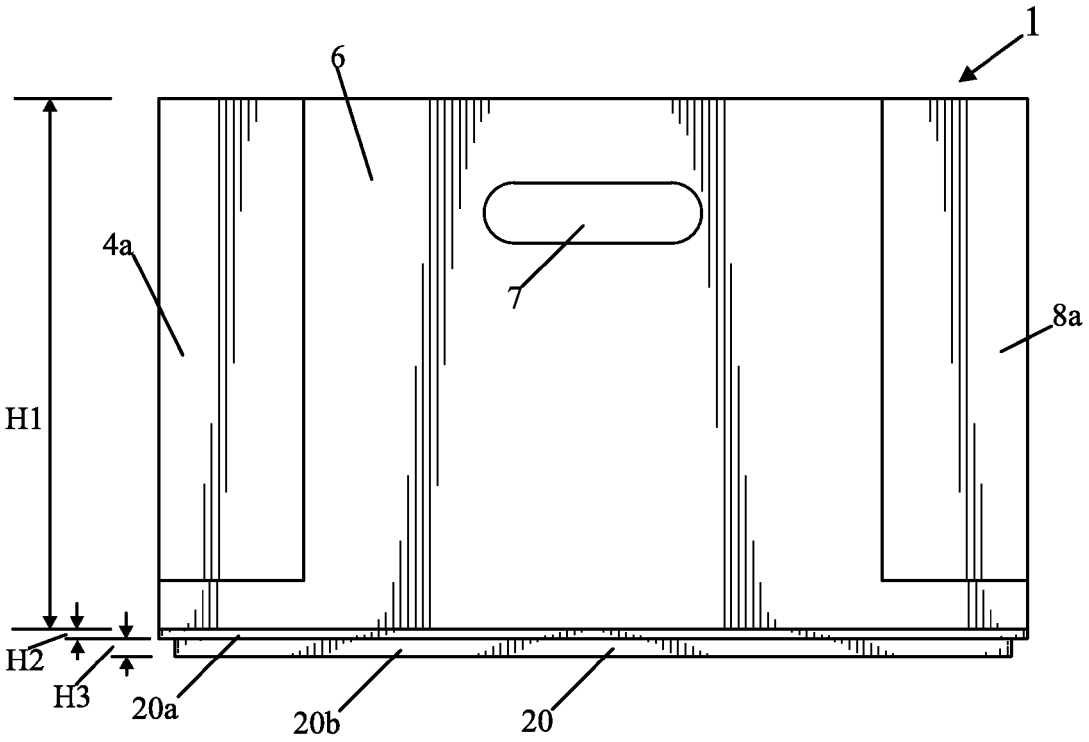
FIG. 2 shows a front view of the receptacle of FIG. 1, with the receptacle of FIG. 1 in the upright assembled state.
Figure 3:
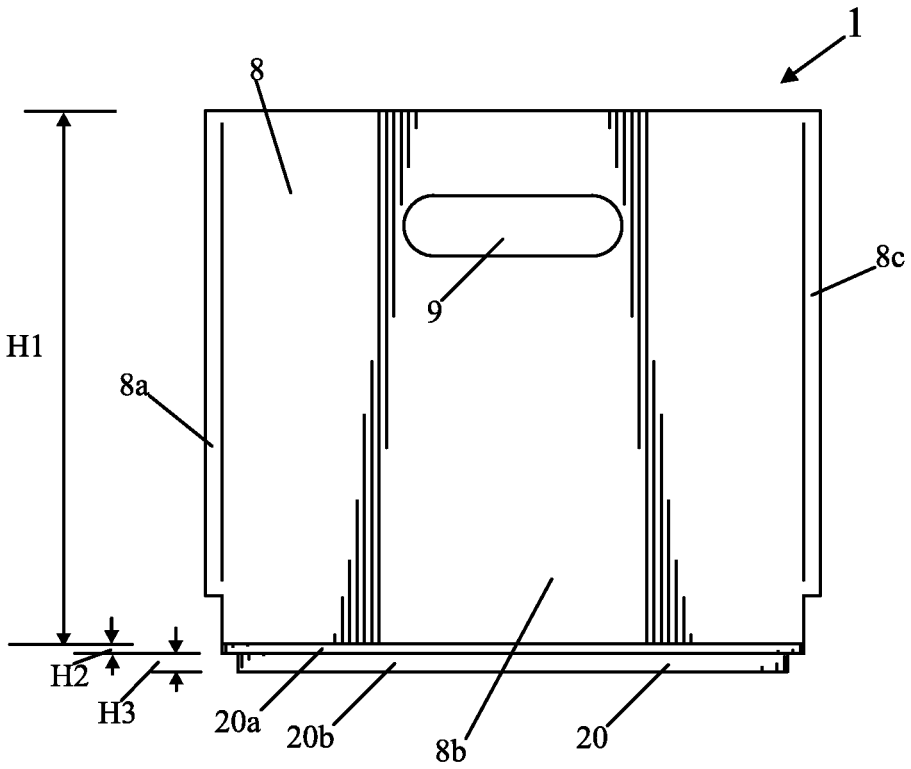
FIG. 3 shows a right side view of the receptacle of FIG. 1, with the receptacle of FIG. 1 in the upright assembled state.
Figure 4:
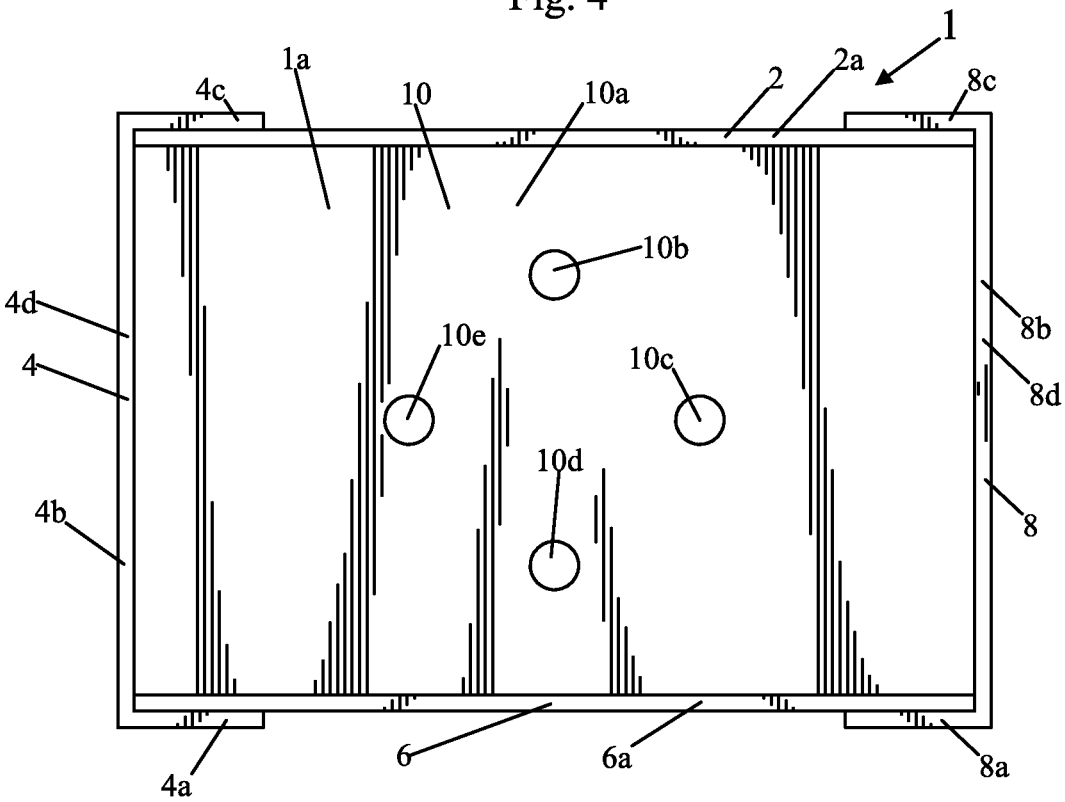
FIG. 4 shows a top view of the receptacle of FIG. 1, with the receptacle of FIG. 1 in the upright assembled state.
Figure 5:
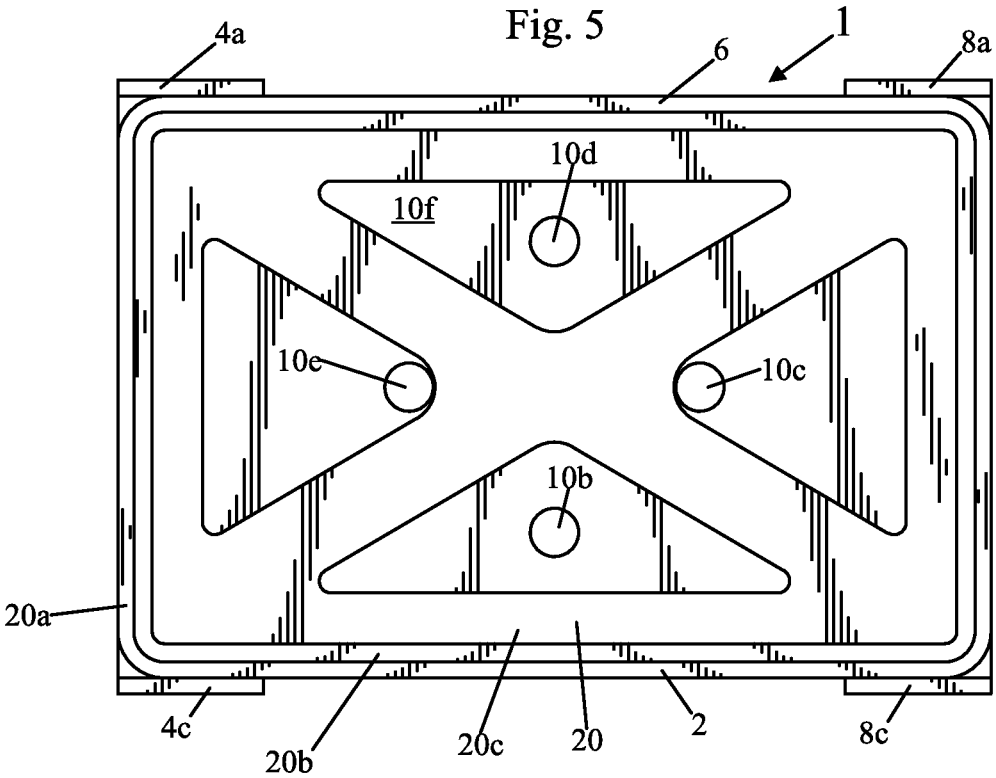
FIG. 5 shows a bottom view of the receptacle of FIG. 1, with the receptacle of FIG. 1 in the upright assembled state.

FIG. 1 shows a top, front, right perspective view of a receptacle 1 in accordance with an embodiment of the present invention, with the receptacle 1 shown in an upright assembled state. FIG. 2 shows a front view of the receptacle 1, with the receptacle 1 in the upright assembled state. FIG. 3 shows a right side view of the receptacle 1 of FIG. 1, with the receptacle 1 in the upright assembled state. FIG. 4 shows a top view of the receptacle 1, with the receptacle 1 in the upright assembled state. FIG. 5 shows a bottom view of the receptacle 1, with the receptacle 1 in the upright assembled state.

Figure 6:
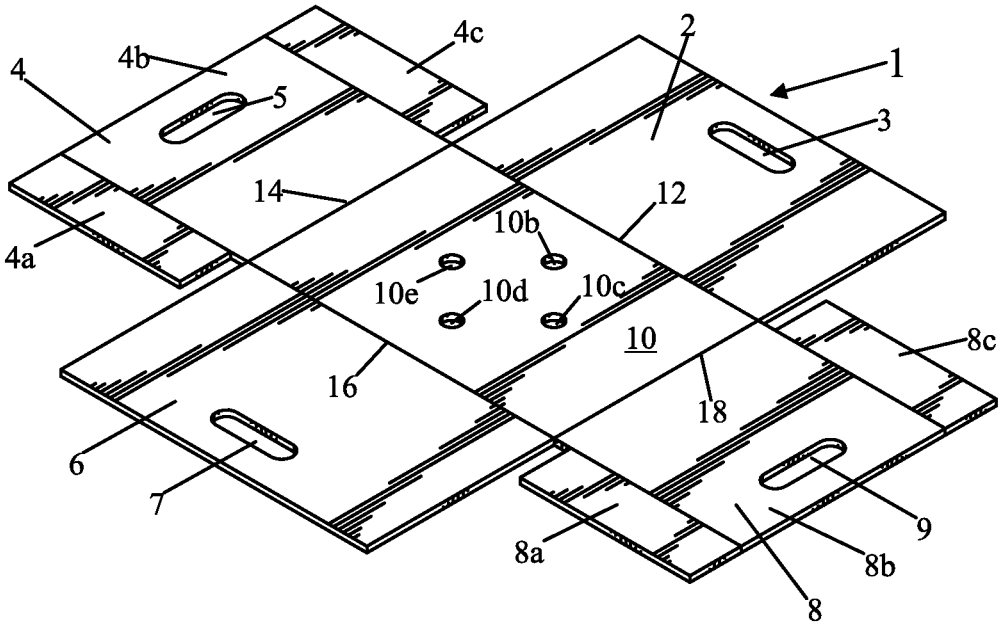
FIG. 6 shows a top, right, front perspective view of the receptacle of FIG. 1, with the receptacle of FIG. 1 in a flattened state.
Figure 7:
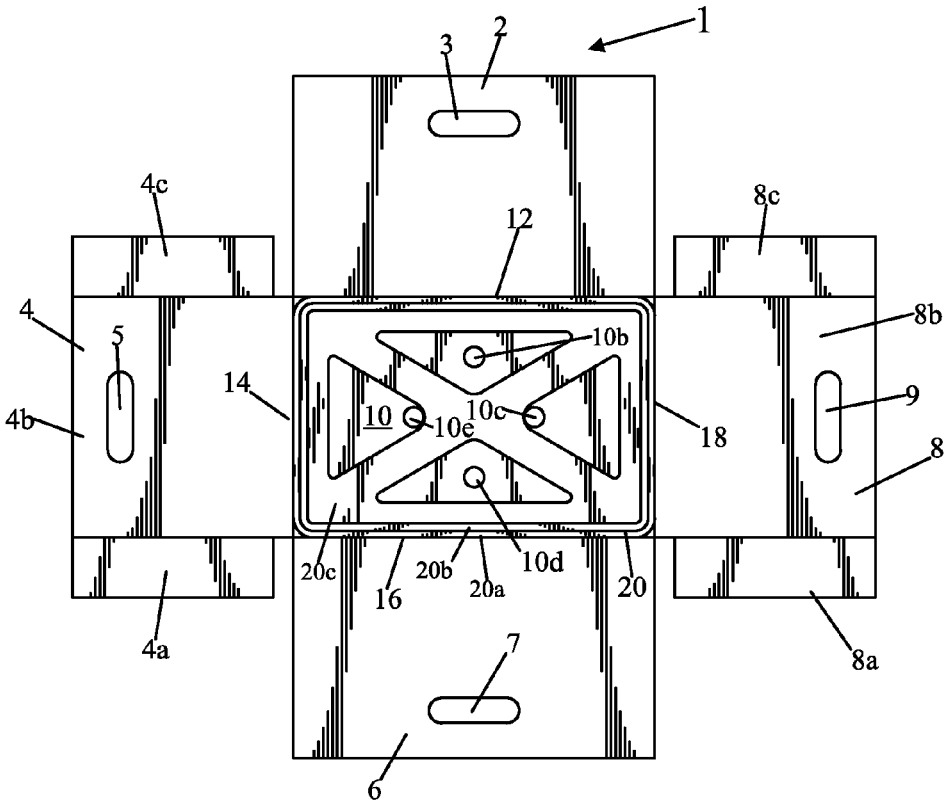
FIG. 7 shows a bottom view of the receptacle of FIG. 1, with the receptacle of FIG. 1 in the flattened state.
Figure 8:
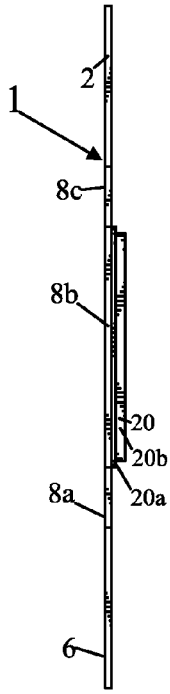
FIG. 8 shows a right side view of the receptacle of FIG. 1, with the receptacle of FIG. 1 in the flattened state.
Figure 9:
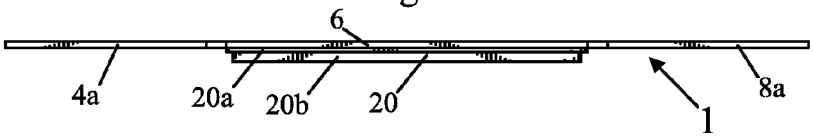
FIG. 9 shows a front view of the receptacle of FIG. 1, with the receptacle of FIG. 1 in the flattened state.

FIG. 6 shows a top, right, front perspective view of the receptacle 1, with the receptacle 1 in a flattened state. FIG. 7 shows a bottom view of the receptacle 1, with the receptacle 1 in the flattened state. FIG. 8 shows a right side view of the receptacle 1, with the receptacle 1 in the flattened state. FIG. 9 shows a front view of the receptacle 1, with the receptacle 1 in the flattened state.

Referring to FIGS. 1-9, the receptacle 1 includes a side or panel 2, a side or panel 6, a side or panel 4, a side or panel 8, and a bottom portion or panel 10. The sides or panels 2, 4, 6, and 8, include openings or elongated slots 3, 5, 7, and 9, respectively, which can be used as handles for lifting the receptacle 1, when it is assembled and upright as in FIG. 1. For example, an individual may lift the receptacle 1 by grapping the handle or opening 5 with a left hand of the individual and the handle or opening 9 with a right hand of the individual. Similarly, an individual may lift the receptacle 1 by grapping the handle or opening 7 with a left hand of the individual and the handle or opening 3 with a right hand of the individual.

The receptacle 1 also includes device 20 which in at least one embodiment aids in stacking and nesting receptacle 1 on top of another similar or identical receptacle, such as receptacle 100 shown in FIGS. 10A-12B. Receptacle 100 may be identical to receptacle 1. The device 20 may be attached to the bottom 10 of the receptacle 1, and/or the device 20 may be manufactured as part of the overall receptacle 1. The device 20 includes an outer wall 20*a* and an inner wall 20*b*.

The side or panel 4 includes sections or panels 4*a*, 4*b*, and 4*c*. Similarly, the side or panel 8 includes sections or panels 8*a*, 8*b*, and 8*c*. The section or panel 4*b* is attached to the bottom 10 along line 14, as shown in FIGS. 6 and 7, by a fold, crease or hinge which allows the panel 4*b* to be folded up or rotated with respect to the bottom 10 from the flattened state of FIG. 6 to the upright state of FIG. 1. Similarly, the section or panel 8*b* is attached to the bottom 10 along line 18, as shown in FIGS. 6 and 7, by a fold, crease or hinge which allows the panel 8*b* to be folded up or rotated with respect to the bottom 10 from the flattened state of FIG. 6 to the upright state of FIG. 1. The sides or panels 2 and 6, are attached to the bottom 10 along lines 12 and 16, as shown in FIGS. 6 and 7, by folds, creases or hinges, respectively, which allow the panels 2 and 6 to be folded up or rotated with respect to the bottom 10 from the flattened state of FIG. 6 to the upright state of FIG. 1.

The device 20 may include an outer peripheral wall 20*a*, an inner peripheral wall 20*b*, and an internal reinforcing structure 20*c*. The device 20 may be made of a biodegradable material. The device 20 may be attached to the bottom 10 by staples, glue, or other attachment devices or fasteners not shown. The entire receptacle 1 may be made of a biodegradable material. The entire receptacle may be made of paper, cardboard, stiff cardboard, or any rigid biodegradable material which can be folded from the flattened state of FIG. 6, where sides 2, 4, 6, and 8 are parallel or substantially parallel to the bottom 10, and sections 4*a* and 4*c* are parallel or substantially parallel to the section 4*b*, and sections 8*a* and 8*c* are parallel or substantially parallel to the section 8*b*, to the upright state of FIG. 1, where sides 2, 4, 6, and 8 are perpendicular or substantially perpendicular to the bottom 10, and sections 4*a* and 4*c* are perpendicular or substantially perpendicular to the central section 4*b* and sections 8*a* and 8*c* are perpendicular to substantially perpendicular to the central section 8*b*. The sections or panels 4*a* and 4*c* may be stapled to the sides 6 and 2 respectively, or otherwise attached, such as by gluing, to fix the panel or side 4 in the upright and assembled state shown in FIG. 1. Similarly, the sections or panels 8*a* and 8*c* may be stapled to the sides 6 and 2 respectively, or otherwise attached, such as by gluing, to fix the panel or side 8 in the upright and assembled state shown in FIG. 1.

The bottom 10 may have circular or substantially circular openings 10*b*, 10*c*, 10*d*, and 10*e*, as shown in FIGS. 4, 5, and 7.

Figure 10A:
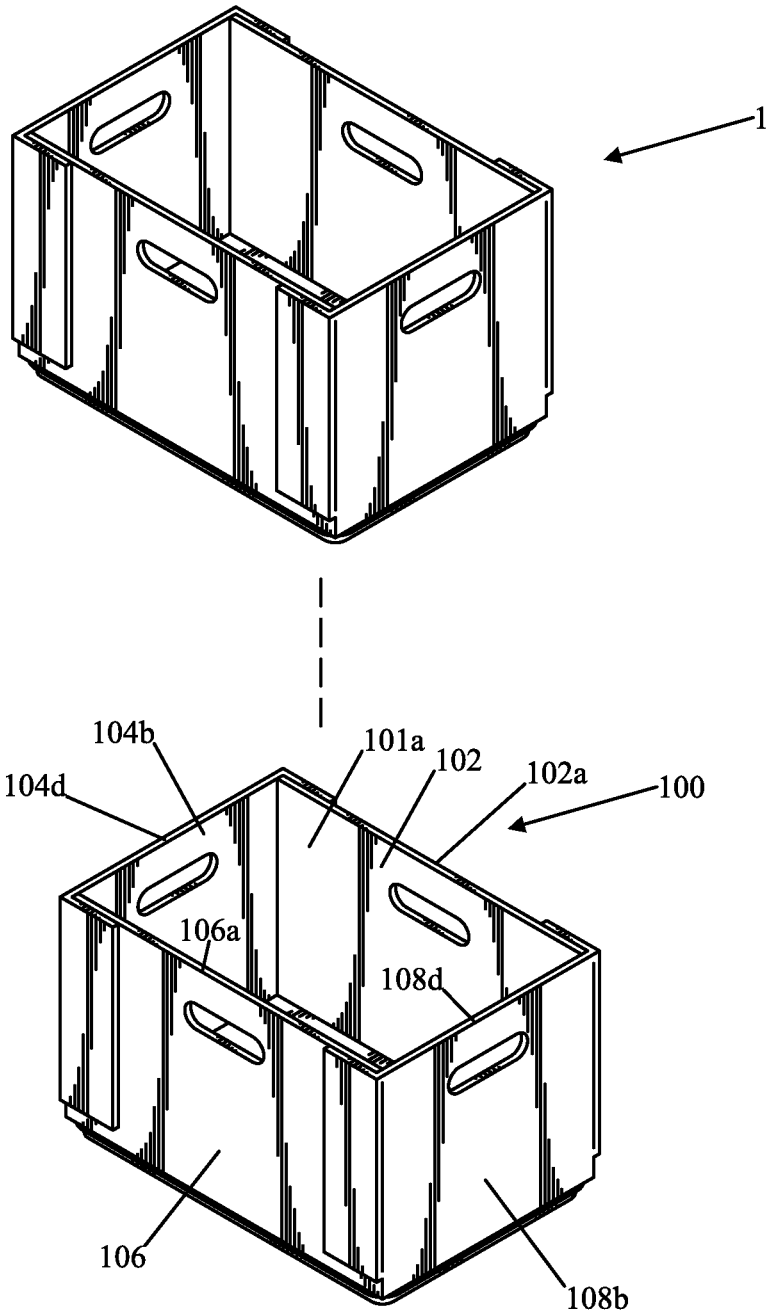
FIG. 10A shows a top, front, right perspective view of the receptacle of FIG. 1, with the receptacle shown in an upright assembled state, and a top, front, right perspective view of an additional receptacle, which may be identical to the receptacle of FIG. 1, with the additional receptacle shown in an upright assembled state.
Figure 10B:
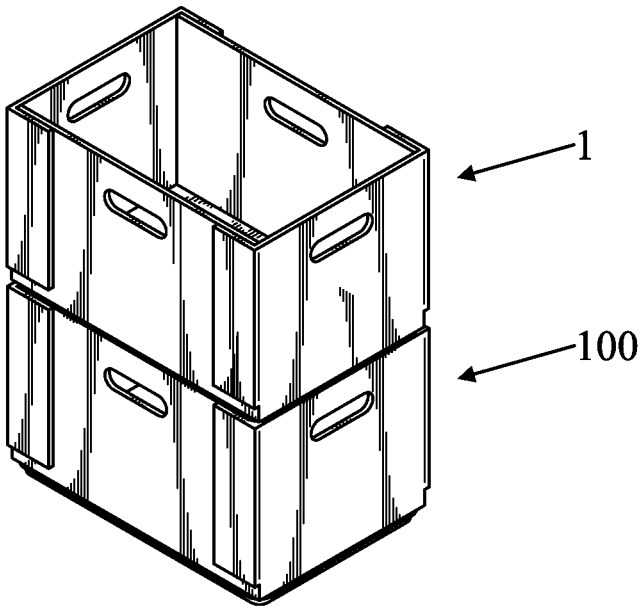
FIG. 10B shows a top, front right perspective view of the receptacle of FIG. 1, stacked on top of the additional receptacle shown in FIG. 10A.

FIG. 10A shows a top, front, right perspective view of the receptacle 1, with the receptacle 1 shown in an upright assembled state, and a top, front, right perspective view of an additional receptacle 100, which may be identical to the receptacle 1 of FIG. 1, with the additional receptacle 100 shown in an upright assembled state. FIG. 10B shows a top, front right perspective view of the receptacle 1, stacked on top of the additional receptacle 100.

Figure 11A:
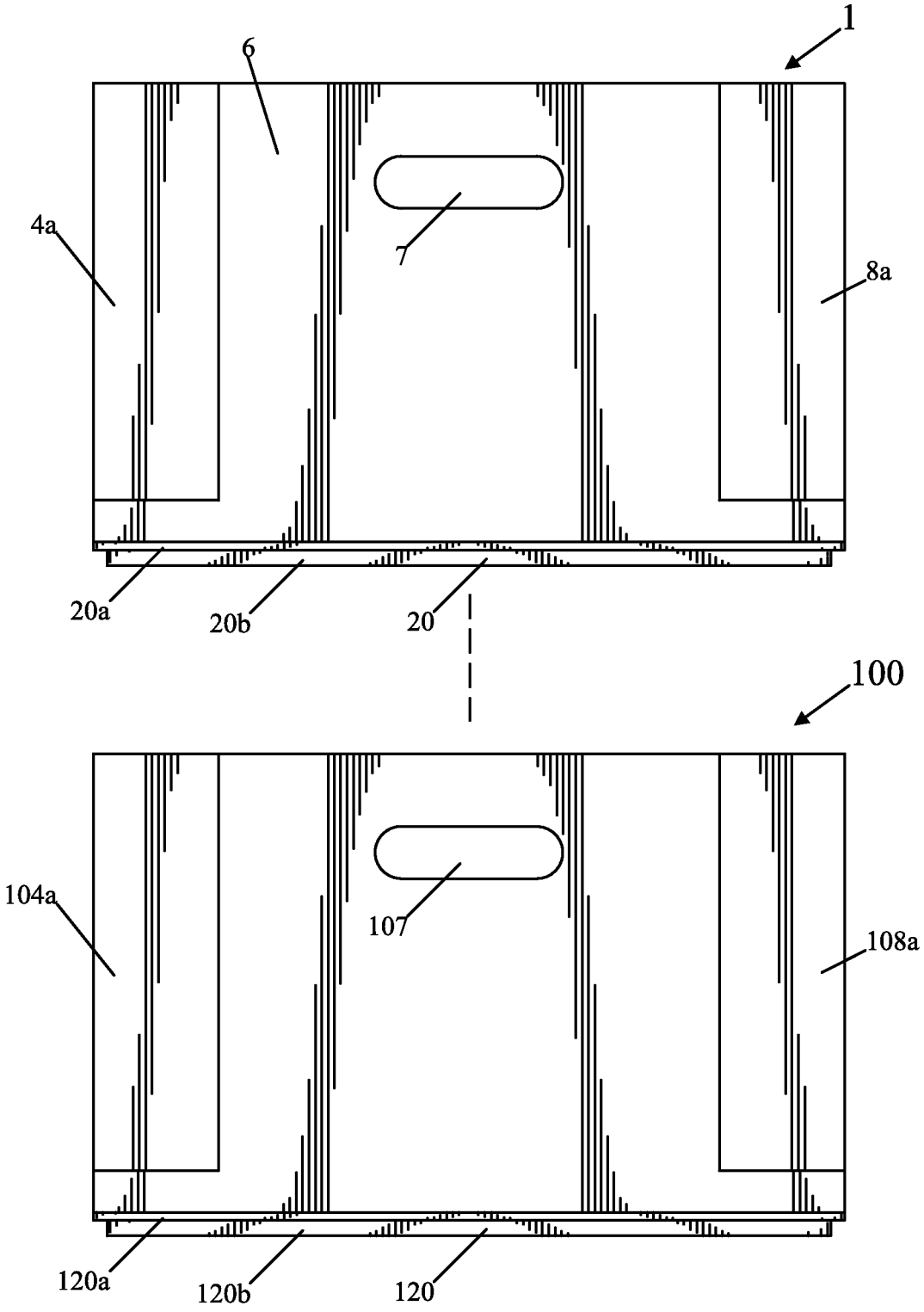
FIG. 11A shows a front view of the receptacle of FIG. 1 and a front view of the additional receptacle of FIG. 10A, with the receptacle of FIG. 1 and the additional receptacle shown in an assembled upright state.
Figure 11B:
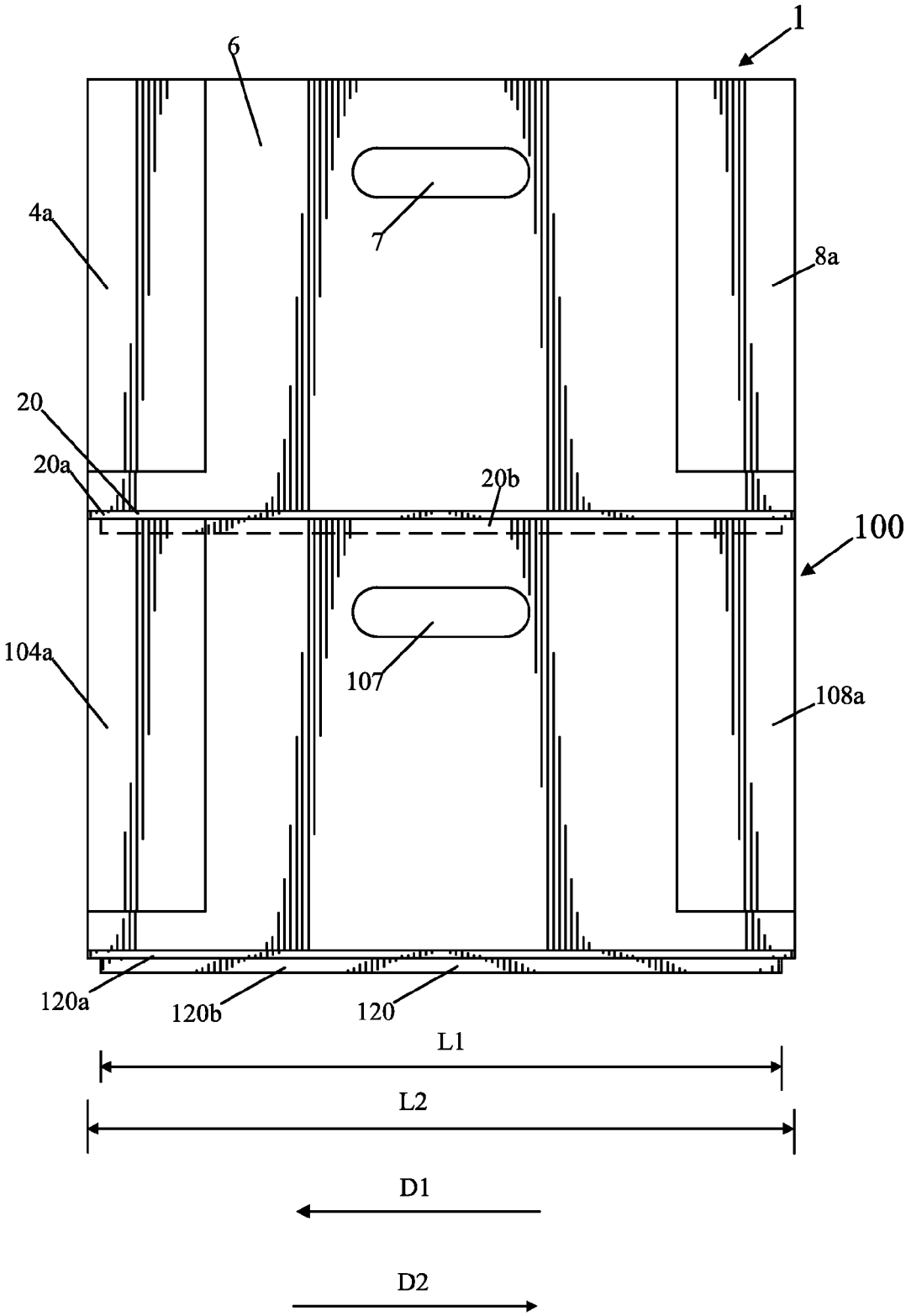
FIG. 11B shows a front view of the receptacle of FIG. 1 stacked on top of the additional receptacle of FIG. 10A, with the receptacle of FIG. 1 and the additional receptacle shown in an assembled upright state.

FIG. 11A shows a front view of the receptacle 1 and a front view of the additional receptacle 100, with the receptacle 1 and the additional receptacle 100 shown in an assembled upright state. FIG. 11B shows a front view of the receptacle 1 stacked on top of the additional receptacle 100, with the receptacle 1 and the additional receptacle 100 shown in an assembled upright state.

Figure 12A:
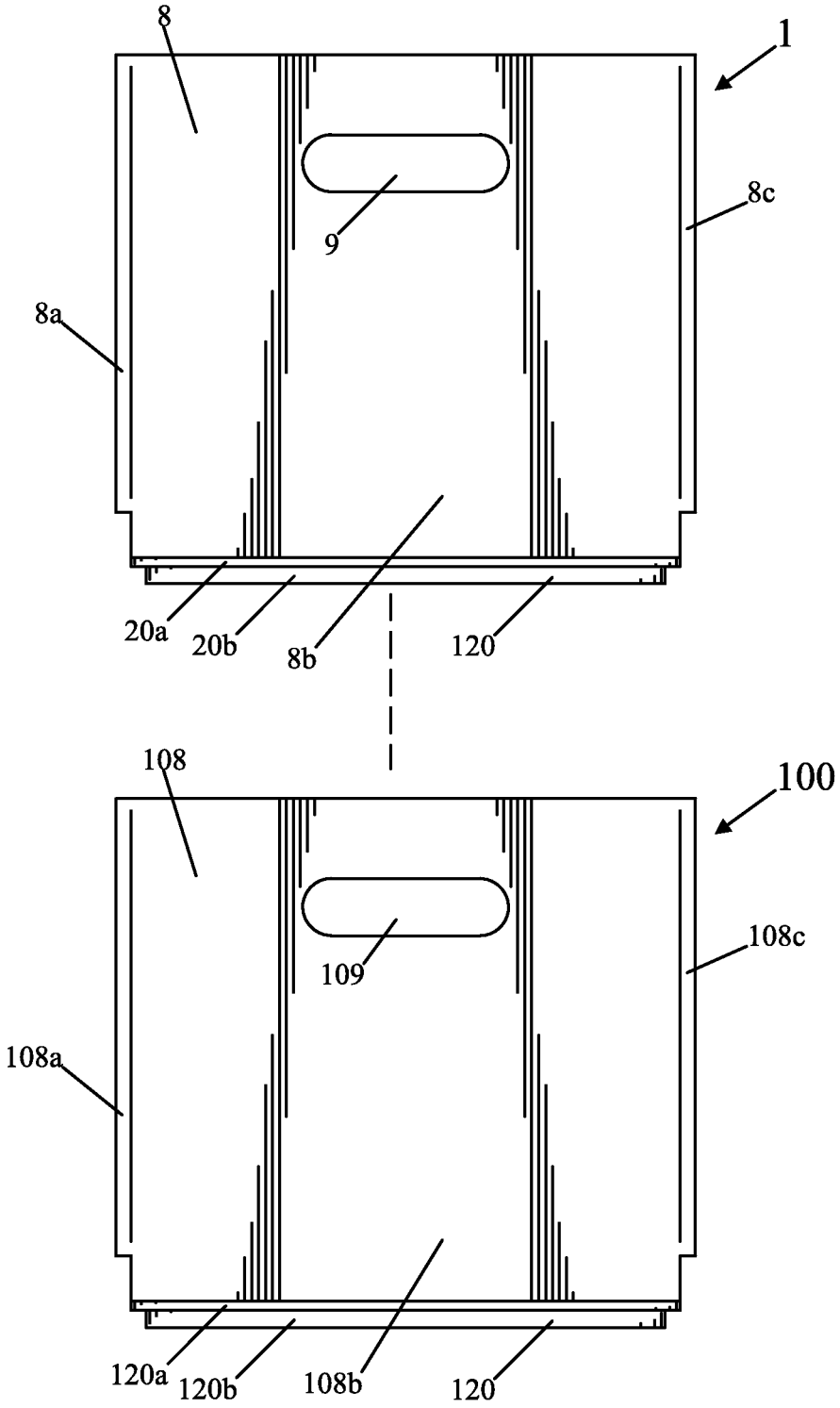
FIG. 12A shows a right side view of the receptacle of FIG. 1 and a right side view of the additional receptacle of FIG. 10A, with the receptacle of FIG. 1 and the additional receptacle shown in an assembled upright state.
Figure 12B:
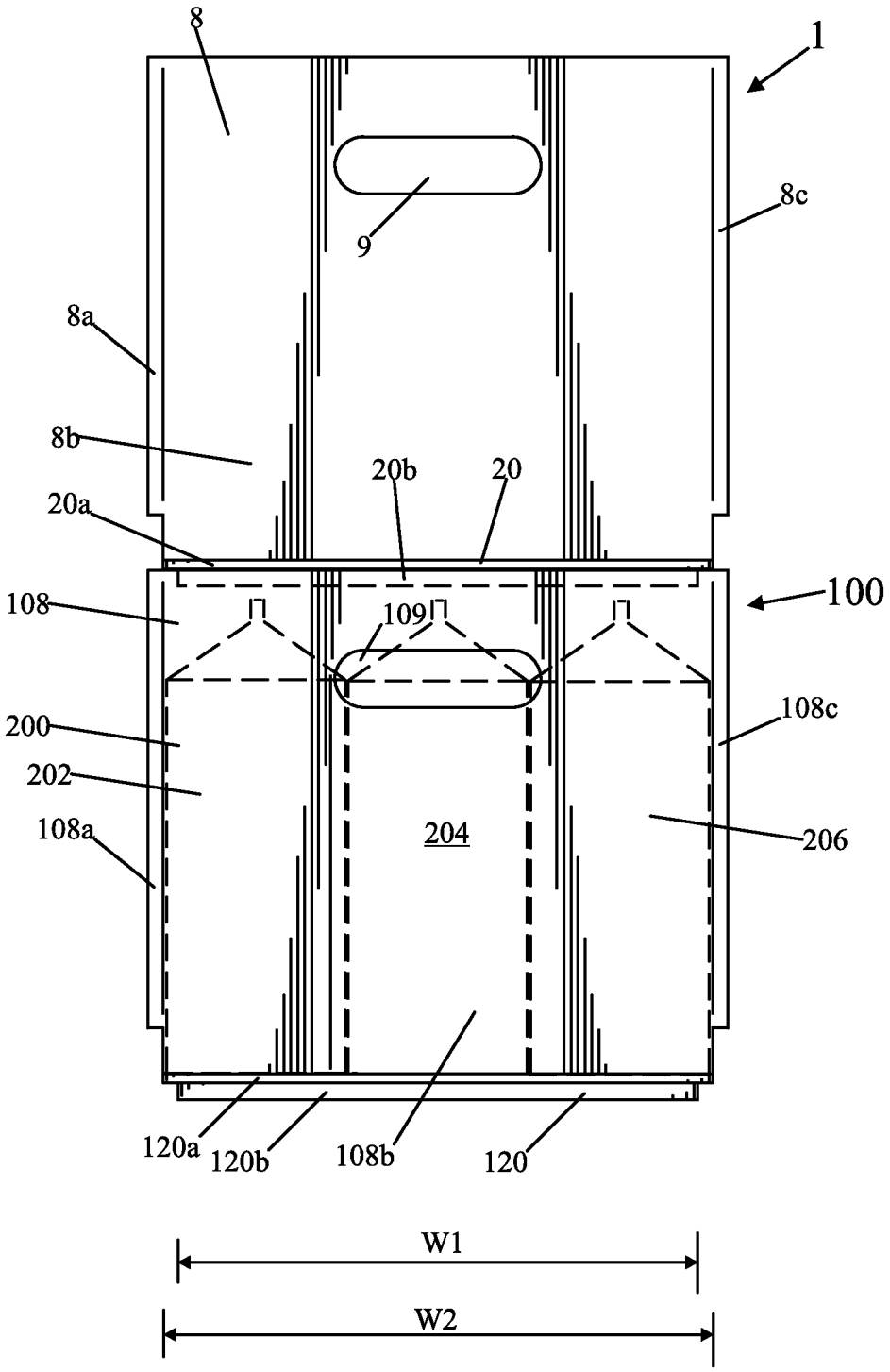
FIG. 12B shows a right side view of the receptacle of FIG. 1 stacked on top of the additional receptacle of FIG. 10A, with the receptacle of FIG. 1 and the additional receptacle shown in an assembled upright state.

FIG. 12A shows a right side view of the receptacle 1 and a right side view of the additional receptacle 100, with the receptacle 1 and the additional receptacle 100 shown in an assembled upright state. FIG. 12B shows a right side view of the receptacle 1 stacked on top of the additional receptacle 100, with the receptacle 1 and the additional receptacle 100 shown in an assembled upright state.

The additional receptacle 100 includes sides 102, 104, 106, and 108, similar or identical to sides 2, 4, 6, and 8 of the receptacle 1. The side 104 includes sections 104*a-c* similar or identical to sections 4*a-c*. The side 108 includes sections 108*a-c* similar or identical to sections 8*a-c*. The receptacle 100 includes device 120 having walls 120*a* and 120*b*, similar or identical to device 20 having walls 20*a* and 20*b*. The receptacle 100 includes handles, similar or identical to handles 3, 5, 7, and 9, including handles 107 and 109 shown in FIGS. 11A and 12A, respectively.

When the receptacle 1 is stacked on top of the receptacle 100, as in FIGS. 10B, 11B, and 12B, the outer peripheral wall 20*a* (shown in FIG. 5) of the receptacle 1 sits on the top edge 104*d* (corresponds to 4*d* shown in FIG. 4) of panel or section 104*b* (shown in FIG. 10A), on the top edge 102*a* (corresponds to 2*a* shown in FIG. 4) of panel 102 (shown in FIG. 10A), on the top edge 106*a* (corresponds to 6*a* shown in FIG. 4) of panel 106 (shown in FIG. 10A), and on the top edge 108*d* (corresponds to 8*d* shown in FIG. 4) of panel or section 108 of the receptacle 100. While the outer peripheral wall 20*a* sits on edges 104*d*, 102*a*, 106*a*, and 108*d*, the inner peripheral wall 20*b* is nested inside of the chamber 101*a* (corresponds to chamber 1*a* shown in FIG. 4) of the receptacle 100, such that the inner peripheral wall 20*b* is surrounded by section 104*b*, side 102, side 106, and section 108*b* shown in FIG. 10A. This nesting arrangement, prevents the receptacle 1 from moving laterally, such as in the directions D1 or D2 shown in FIG. 11B, when the receptacle 1 is stacked and nested on top of the receptacle 100 as in FIGS. 11B and 12B. In FIGS. 11B and 12B, the location of the inner peripheral wall 20*b* is shown by a dashed lines because the inner peripheral wall 20*b* is typically not visible when it is nested inside of the receptacle 100.

The inner wall 20*b* may have a length L1, shown in FIG. 11B, which may be seventeen and five eighths inches and a width W1, shown in FIG. 12B, which may be eleven and five eighths inches. The outer wall 20*a* may have a length L2, shown in FIG. 11B, which may be eighteen inches and a width W2, shown in FIG. 12B, which may be twelve inches. Other sizes may be used but these sizes are particularly useful for a twenty four quart milk case.

The receptacle 1 is particularly useful in the dairy industry for carrying quarts or other containers of milk.

Each of the panels or sides 2, 4, 6, and 8 may have a height of H1, shown in FIG. 2 and FIG. 3, which may be about eleven inches. The outer wall 20*a* of the device 20 may have a height H2, shown in FIG. 2 and FIG. 3, which may be about three thirty-seconds (3/32) of an inch. The inner wall 20*b* of the device 20 may have a height H3, shown in FIG. 2 and FIG. 3, which may be about three eighths (3/8) of an inch. The height, H3, of the inner wall 20*b* is configured so that it is sufficient to provide a nesting feature when the receptacle 1 is stacked on top of the receptacle 100 as in FIGS. 11B and 12B, but not too large so that the inner wall 20*b* does not contact beverage containers, such as milk cartons 200, shown by dashed lines in FIG. 12B, placed in chamber 101*a* (shown in FIG. 10A) of the receptacle 100. In FIG. 12B the milk cartons 200 include milk carton 202, 204, and 206 shown by dashed lines. The milk cartons 200 would include further milk cartons not shown in the direction of the length L1 of FIG. 11B, so that there would typically be a plurality of rows in the direction of length L1 of FIG. 11B of milk cartons or other beverage containers, and a plurality of columns of milk cartons or other beverage containers in the direction of width W1 of FIG. 12B. The receptacle 1 and the milk cartons 200 or other beverage containers are configured so that the inner wall 20*b* does not contact the top of milk cartons 202, 204, and 206 and the inner wall 20*b* does not contact other milk cartons which are not shown. In at least one embodiment the receptacle 1 is configured so that a matrix of milk cartons, fits snugly, upright, inside of the chamber 1*a* of the receptacle 1 or chamber 101*a* of the receptacle 100, when the cartons 200 are standing upright as in FIG. 12B.

The receptacle 1 may be made of a moisture absorbing material to absorb moisture that may leak or spill out of beverage containers, such as milk cartons. The receptacle 1, including the device 20 may be disposable.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. A method comprising attaching a device to a bottom of a box portion to form an apparatus;

wherein the box portion includes:

a left side, a right side, a front side, a rear side, and the bottom;

wherein each of the left, the right, the front, and the rear sides are connected to the bottom so that each is configured to be foldable with respect to the bottom, from an orientation parallel to the bottom to an orientation substantially perpendicular to the bottom;

wherein the device includes an inner peripheral wall which extends, for a height of the inner wall, substantially perpendicularly from the bottom;

wherein the inner peripheral wall is substantially in the shape of a loop and has a width and a length, substantially perpendicular to the height of the device, wherein the width and the length of the inner peripheral wall are slightly less than a width and a length, respectively, of an inner chamber of the apparatus defined by top edges of the left, the right, the front, and the rear sides, when the box portion is in an upright state such that the left, the right, the front, and the rear sides are substantially perpendicular to the bottom, so that the inner peripheral wall of the apparatus is configured to fit snugly into an inner chamber of a second apparatus which is identical to the apparatus, and wherein the inner chamber of the second apparatus is identical to the inner chamber of the apparatus;

wherein the left side of the box portion includes first and second outer sections, and a central section, wherein the first outer section of the left side is connected to a first end of the central section of the left side and the second outer section of the left side is connected to a second end of the central section of the left side, which opposes the first end of the central section of the left side;

wherein the right side of the box portion includes first and second outer sections, and a central section, wherein the first outer section of the right side is connected to a first end of the central section of the right side and the second outer section of the right side is connected to a second end of the central section of the right side, which opposes the first end of the central section of the right side;

wherein each of the first and the second outer sections of the left side are connected to the central section of the left side so that each is configured to be foldable with respect to the central section of the left side, from an orientation parallel to the central section of the left side to an orientation substantially perpendicular to the central section of the left side; and wherein each of the first and the second outer sections of the right side are connected to the central section of the right side so that each is configured to be foldable with respect to the central section of the right side, from an orientation parallel to the central section of the right side to an orientation substantially perpendicular to the central section of the right side.

2. The method of claim 1 wherein the box portion and the device are made of a biodegradable material.

3. The method of claim 1 wherein the box portion and the device are made of a moisture absorbing material.

4. The method of claim 1 further comprising fitting a fixed number of a first plurality of beverage containers in an upright state in the inner chamber of the apparatus.

5. The method of claim 4 wherein wherein the height of the inner peripheral wall of the device is configured so that when the inner peripheral wall is inserted into an inner chamber of a second apparatus identical to the apparatus, in a manner to cause the first apparatus to be supported by the second apparatus, the inner peripheral wall does not contact any of a second plurality of beverage containers which fit snugly, in an upright state in the inner chamber of the second apparatus.

6. The method of claim 1 further comprising changing orientations of the right, left, front, and rear sides with respect to the bottom from a flattened state in which each of the right, left, front, and rear sides are substantially parallel to the bottom to an upright state in which each of the right, left, front, and rear sides are substantially perpendicular to the bottom;

attaching the right side to the front and rear sides in the upright state; and attaching the left side to the front and rear sides in the upright state.

7. The method of claim 1 further comprising changing orientations of the right, left, front, and rear sides with respect to the bottom from a flattened state in which each of the right, left, front, and rear sides are substantially parallel to the bottom to an upright state in which each of the right, left, front, and rear sides are substantially perpendicular to the bottom;

attaching the right side to the front and rear sides in the upright state; and attaching the left side to the front and rear sides in the upright state;

wherein the right side is attached to the front side by attaching the first outer section of the right side to the front side, and the right side is attached to the rear side by attaching the second outer section of the right side to the rear side; and wherein the left side is attached to the front side by attaching the first outer section of the left side to the front side, and the left side is attached to the rear side by attaching the second outer section of the left side to the rear side.

8. The method of claim 1 further comprising stacking the apparatus onto a second apparatus which is identical to the apparatus such that the box portion of the apparatus is in an upright state such that the left, the right, the front, and the rear sides are substantially perpendicular to the bottom, and a box portion of the second apparatus is in an upright state such that the left, the right, the front, and the rear sides are substantially perpendicular to the bottom, and the inner peripheral wall of the apparatus is fit snugly into an inner chamber of the second apparatus, and wherein the inner chamber of the second apparatus is identical to the inner chamber of the apparatus.

* * * * *